US009666945B2

(12) United States Patent
Kwak et al.

(10) Patent No.: US 9,666,945 B2
(45) Date of Patent: May 30, 2017

(54) MULTI-BAND ANTENNA AND APPARATUS AND METHOD FOR ADJUSTING OPERATING FREQUENCY OF THE MULTI-BAND ANTENNA IN A WIRELESS COMMUNICATION SYSTEM

(75) Inventors: Yong-Soo Kwak, Suwon-si (KR); Joon-Ho Byun, Yongin-si (KR); Seong-Tae Jeong, Yongin-si (KR); Bum-Jin Cho, Hwaseong-si (KR); Soon-Ho Hwang, Seoul (KR); Austin Kim, Seongnam-si (KR); Jae-Hoon Jo, Seoul (KR); Jae-Hyung Kim, Seoul (KR); A-Hyun Sin, Busan (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 209 days.

(21) Appl. No.: 13/395,789

(22) PCT Filed: Sep. 17, 2010

(86) PCT No.: PCT/KR2010/006451

§ 371 (c)(1),
(2), (4) Date: Mar. 13, 2012

(87) PCT Pub. No.: WO2011/034391

PCT Pub. Date: Mar. 24, 2011

(65) Prior Publication Data

US 2012/0169546 A1 Jul. 5, 2012

(30) Foreign Application Priority Data

Sep. 17, 2009 (KR) ..... 10-2009-0088095

(51) Int. Cl.

| | |
|---|---|
| ***H01Q 9/04*** | (2006.01) |
| ***H01Q 9/14*** | (2006.01) |
| ***H01Q 5/00*** | (2015.01) |
| ***H01Q 5/371*** | (2015.01) |

(52) U.S. Cl.
CPC ..... *H01Q 9/0421* (2013.01); *H01Q 5/371* (2015.01); *H01Q 9/145* (2013.01)

(58) Field of Classification Search
CPC ..... H01Q 9/0421; H01Q 9/145
USPC ..... 343/700 MS, 702, 876
See application file for complete search history.

(56) References Cited

U.S. PATENT DOCUMENTS

| | | | | |
|---|---|---|---|---|
| 6,753,815 | B2 | 6/2004 | Okubora et al. | |
| 2003/0142022 | A1 | 7/2003 | Ollikainen et al. | |
| 2003/0151555 | A1* | 8/2003 | Holshouser | 343/700 MS |
| 2004/0027288 | A1* | 2/2004 | Okubora | H01Q 1/243 343/700 MS |

(Continued)

FOREIGN PATENT DOCUMENTS

| | | |
|---|---|---|
| EP | 1 396 906 A1 | 3/2004 |
| EP | 2 048 739 A1 | 4/2009 |

(Continued)

*Primary Examiner* — Graham Smith
*Assistant Examiner* — Daniel J Munoz
(74) *Attorney, Agent, or Firm* — Jefferson IP Law, LLP

(57) ABSTRACT

An apparatus and method for adjusting an operating frequency of a multi-band antenna and a system supporting the same in a wireless communication system are provided, in which a plurality of shorting pins spaced from a radiation patch by difference distances, and a switch connects one of the shorting pins to the radiation patch.

10 Claims, 8 Drawing Sheets

(56) References Cited

U.S. PATENT DOCUMENTS

| | | | | |
|---|---|---|---|---|
| 2004/0070537 | A1* | 4/2004 | Kadambi et al. | 343/700 MS |
| 2006/0181465 | A1* | 8/2006 | Kim | 343/702 |
| 2007/0247373 | A1* | 10/2007 | Egorov | 343/702 |
| 2009/0051611 | A1 | 2/2009 | Shamblin et al. | |
| 2009/0224991 | A1 | 9/2009 | Rowson et al. | |
| 2010/0033397 | A1* | 2/2010 | Narasimhan et al. | 343/860 |
| 2011/0102290 | A1* | 5/2011 | Milosavljevic | H01Q 1/243 343/852 |
| 2011/0275333 | A1* | 11/2011 | Kim et al. | 455/77 |

FOREIGN PATENT DOCUMENTS

| | | | |
|---|---|---|---|
| JP | 2001-136019 | A | 5/2001 |
| JP | 2002-261533 | A | 9/2002 |
| WO | 2007/012697 | A1 | 2/2007 |
| WO | 2009 052234 | A1 | 4/2009 |

* cited by examiner

MULTI-BAND ANTENNA AND APPARATUS AND METHOD FOR ADJUSTING OPERATING FREQUENCY OF THE MULTI-BAND ANTENNA IN A WIRELESS COMMUNICATION SYSTEM

PRIORITY

This application is a National Stage application under 35 U.S.C. §371 of an International application filed on Sep. 17, 2010 and assigned application No. PCT/KR2010/006451, and claims the benefit under 35 U.S.C. §365(b) of a Korean patent application filed Sep. 17, 2009 in the Korean Intellectual Property Office and assigned application No. 10-2009-0088095, the entire disclosure of which is hereby incorporated by reference.

TECHNICAL FIELD

The present invention generally relates to a multi-band antenna. More particularly, the present invention relates to a multi-band antenna and an apparatus and method for adjusting the operating frequency of the multi-band antenna in a wireless communication system.

BACKGROUND ART

As a variety of mobile communication services have recently been popular, more frequency bands need to be supported in a single terminal. 2.5th Generation (2.5G) and $3^{rd}$ Generation (3G) mobile communication systems deployed around the world use different frequency bands in different regions.

Extensive research has been conducted on a portable terminal that can operate in mobile communication systems having different frequency bands. For example, the portable terminal may operate in low-band systems such as Global System for Mobile Communications 850 (GSM 850) and GSM 900 and in high-band systems such as Digital Cellular System (DCS), Personal Communication Services (PCS), and Universal Mobile Telecommunication System 2100 (UMTS 2100), as well. To implement the multi-band terminal, studies have been conducted on an antenna which can operate in multiple bands.

Antennas used for conventional portable terminals include a monopole antenna, a loop antenna, an Inverted F-Antenna (IFA), and a Planar Inverted F-Antenna (PIFA). However, it is difficult to achieve broadband characteristics with these antennas because of a limited space for installing an antenna in a portable terminal.

For example, when a terminal is to operate in low bands such as GSM 850 and GSM 900, a small size and a broad Fractional Bandwidth (FBW) are required for the terminal. Hence, the required bandwidth is hard to secure simply with use of a single antenna. To avert this problem, an IFA-based or PIFA-based switchable antenna has been proposed, which operates at an intended operating frequency by changing the distance between a shorting pin and a feed point through selection of one of shorting pins and thus controlling the impedance of the antenna.

FIGS. 1 and 2 illustrate a conventional PIFA-based switchable antenna configured so as to operate in different frequency bands. Specifically, FIG. 1 is a perspective view of the conventional PIFA-based switchable antenna and FIG. 2 is a plan view of the conventional PIFA-based switchable antenna.

FIGS. 1 and 2, the conventional PIFA-based switchable antenna is configured to include a plurality of shorting pins 101 such that its resonant frequency is changed by controlling its impedance. Specifically, the impedance of the conventional switchable antenna is controlled by selecting one of the shorting pins 101 through a switch 107 and thus adjusting the distance between the selected shorting pin 101 and a feeding point 103.

FIGS. 3 to 6 illustrate operations of the conventional PIFA-based switchable antenna.

FIGS. 3 and 4 illustrate the off and on states of the switch 107, respectively. FIG. 5 is a graph illustrating reflection coefficients S11 with respect to antenna frequencies in the operations of FIGS. 3 and 4, and FIG. 6 is a Smith chart illustrating impedances with respect to antenna frequencies in the operations of FIGS. 3 and 4.

Referring to FIG. 3, since the switch 107 is off, a shorting pin 201 is not shorted to a ground plane 205. Thus, when power is supplied to the switchable antenna, current flows through a feed point 203. Referring to FIG. 4, the switch 107 switches the shorting pin 201 to the ground plane 205. Thus, when power is supplied to the antenna, current flows through the shorting pin 201. In both cases illustrated in FIGS. 3 and 4, as current flows through different shorting pins, the impedance of the switchable antenna is changed. Consequently, the resonant frequency of the switchable antenna may be changed.

The reflection coefficients and impedances of the switchable antenna in the cases of FIGS. 3 and 4 are illustrated in FIGS. 5 and 6.

Referring to FIG. 5, a dotted line 207 represents the reflection coefficients of the switchable antenna in the case of FIG. 3 and a solid line 209 represents the reflection coefficients of the switchable antenna in the case of FIG. 4. Each curve has two valleys and a frequency corresponding to the minimum reflection coefficient of each valley is an operating frequency of the switchable antenna. For example, on the curve 207, a frequency corresponding to the bottom of the left valley 211 is the low-band operating frequency of the switchable antenna (about 850 MHz) and a frequency corresponding to the bottom of the right valley 213 is the high-band operating frequency of the switchable antenna (about 1760 MHz). The same thing applies to the curve 209. However, it is noted from the curves 207 and 209 that there is little difference between the operating frequencies of the switchable antenna in the cases of FIGS. 3 and 4.

Little difference between the operating frequencies in the two cases is also observed in FIG. 6. Impedance variations with respect to antenna frequencies in the operations of FIGS. 3 and 4 are illustrated on the Smith chart of FIG. 6. Reference numeral 215 denotes the impedance of the switchable antenna in FIG. 3 and reference numeral 217 denotes the impedance of the switchable antenna in FIG. 4. Reference numerals 219 and 221 denote impedance variations in low and high bands, respectively. The Smith chart reveals that there is little difference in the distances from the origin (i.e. locuses) regarding impedance variations. The distance from the origin of the Smith chart means the magnitude of impedance. Therefore, when it is said that there is almost no change in the impedance magnitude, this means that there is almost no change in the resonant frequency of the antenna. This result is attributed to the shunt L matching effect of the shorting pins as impedance matching. Due to the shunt L matching, although the phase of impedance may change greatly, a change in the magnitude of the impedance is relatively small.

DISCLOSURE OF INVENTION

Technical Problem

As described above, the conventional method of adjusting the distance between a feed point and a shorting pin to implement a multi-band antenna does not change the resonant frequency of an antenna significantly. Therefore, the conventional method has limitations in its effectiveness in implementing a multi-band antenna in a portable terminal.

This problem is conspicuous especially in low band. Since a high-band antenna is short in length, it is not difficult to implement a multi-band antenna that operates in different high bands in a portable terminal. However, a low-band antenna is long relative to an antenna installation area available in a portable terminal. Hence, it is difficult to realize an antenna that can operate simultaneously in different low bands.

Solution to Problem

An aspect of exemplary embodiments of the present invention is to address at least the problems and/or disadvantages and to provide at least the advantages described below. Accordingly, an aspect of exemplary embodiments of the present invention is to provide a multi-band antenna in a wireless communication system.

Another aspect of exemplary embodiments of the present invention is to provide an apparatus and method for adjusting the operating frequency of a multi-band antenna in a wireless communication system.

Another aspect of exemplary embodiments of the present invention is to provide a multi-band antenna that operates in low bands in a portable terminal.

A further aspect of exemplary embodiments of the present invention is to provide an apparatus and method for adjusting the operating frequency of a multi-band antenna that operates in low bands in a portable terminal.

In accordance with an aspect of exemplary embodiments of the present invention, there is provided a multi-band antenna including a radiation patch, a plurality of shorting pins spaced from the radiation patch by difference distances, and a switch for connecting one of the shorting pins to the radiation patch. The multi-band antenna may further include a controller for controlling the switch to select one of the shorting pins according to an operating frequency of the multi-band antenna. The multi-band antenna may be one of an Inverted F-Antenna (IFA) and a Planar Inverted F-Antenna (PIFA).

In accordance with another aspect of exemplary embodiments of the present invention, there is provided a multi-band antenna including a radiation patch, a plurality of shorting pins spaced from a ground plane of the multi-band antenna by difference distances, and a switch for connecting one of the shorting pins to the radiation patch. The multi-band antenna may further include a controller for controlling the switch to select one of the shorting pins according to an operating frequency of the multi-band antenna. The multi-band antenna may be one of an IFA and a PIFA.

In accordance with another aspect of exemplary embodiments of the present invention, there is provided a method for controlling an operating frequency of a multi-band antenna having a radiation patch and a plurality of shorting pins spaced from a ground plane by different distances, in which one of the shorting pins is selected according to an operating frequency of the multi-band antenna by a controller, and the selected shorting pin is connected to the radiation patch by a switch. The multi-band antenna may be one of an IFA and a PIFA.

In accordance with a further aspect of exemplary embodiments of the present invention, there is provided a method for controlling an operating frequency of a multi-band antenna having a radiation patch and a plurality of shorting pins spaced from a ground plane by different distances, in which one of the shorting pins is selected according to an operating frequency of the multi-band antenna by a controller, and the selected shorting pin is connected to the radiation patch by a switch. The multi-band antenna may be one of an IFA and a PIFA.

Advantageous Effects of Invention

As is apparent from the above description of the present invention, the amount of coupling between a radiation patch and a shorting pin or between a ground and a shorting pin is controlled by selecting one of a plurality of shorting pins having different paths and connecting the selected shorting pin to a switch, in an antenna. Thus the resonant frequency of the antenna is changed greatly. Consequently, a portable terminal having a small antenna installation space can operate in multiple bands.

BRIEF DESCRIPTION OF DRAWINGS

The above and other objects, features and advantages of certain exemplary embodiments of the present invention will be more apparent from the following detailed description taken in conjunction with the accompanying drawings, in which.

Throughout the drawings, the same drawing reference numerals will be understood to refer to the same elements, features and structures.

MODE FOR THE INVENTION

The matters defined in the description such as a detailed construction and elements are provided to assist in a comprehensive understanding of exemplary embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Before describing the present invention in detail, the basic principle of the present invention will first be described in brief.

The operating frequency of an antenna is changed by adjusting the amount of coupling between a radiation patch and a shorting pin through control of the distance between the radiation patch and the shorting pin or the distance between a ground and the shorting pin in the antenna. Specifically, in an antenna of an IFA or PIFA configuration including a plurality of shorting pins, a radiation patch of the antenna is connected to one of the shorting pins, thereby changing the impedance of the antenna according to the amount of coupling between the shorting pin and the radiation patch. Consequently, the resonant frequency of the antenna is controlled to thereby operate the antenna in an intended frequency band.

Figure 1:
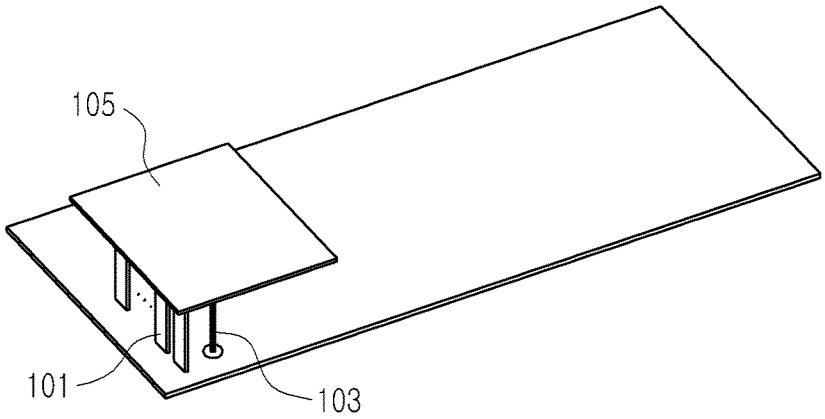
FIG.1 (RELATED ART)
FIGS. 1 and 2 illustrate a conventional PIFA-based switchable antenna that can switch to different frequency bands.
Figure 2:
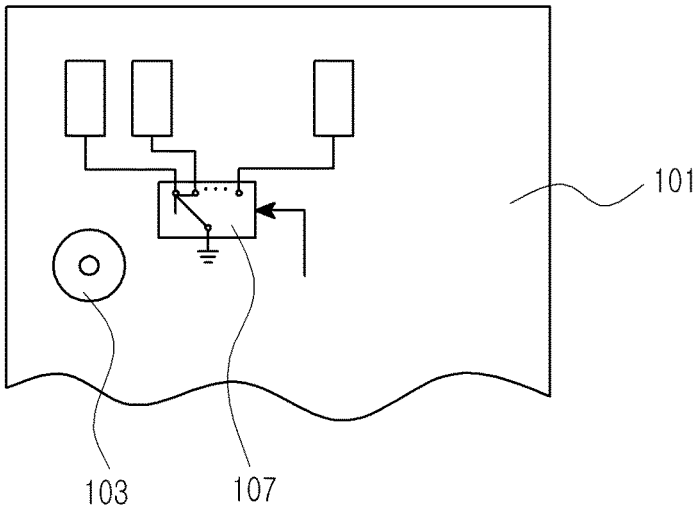
FIG.2 (RELATED ART)
Figure 3:
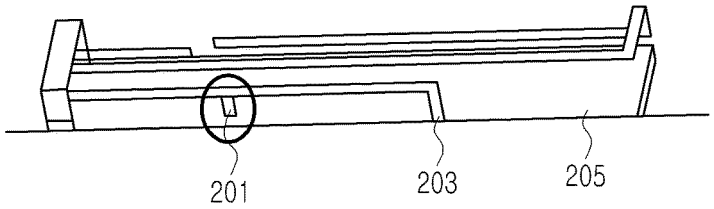
FIG.3 (RELATED ART)
FIGS. 3 to 6 illustrate exemplary operations of the conventional PIFA-based switchable antenna.
Figure 4:
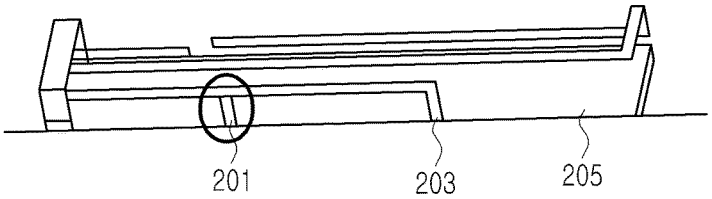
FIG.4 (RELATED ART)
Figure 5:
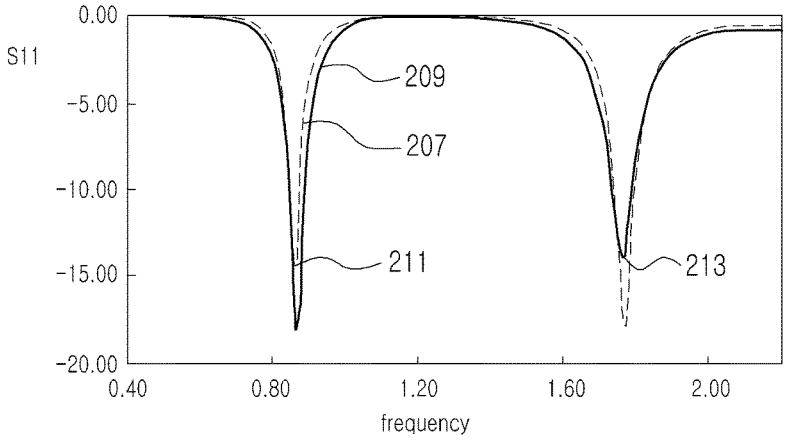
FIG.5 (RELATED ART)
Figure 6:
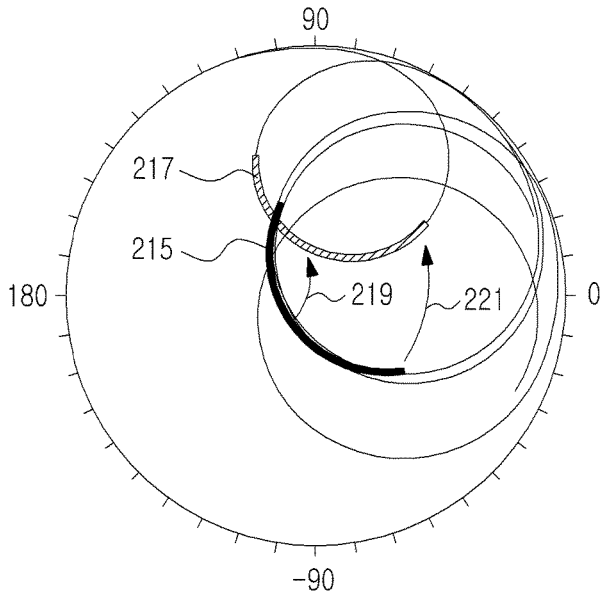
FIG.6 (RELATED ART)
Figure 7:
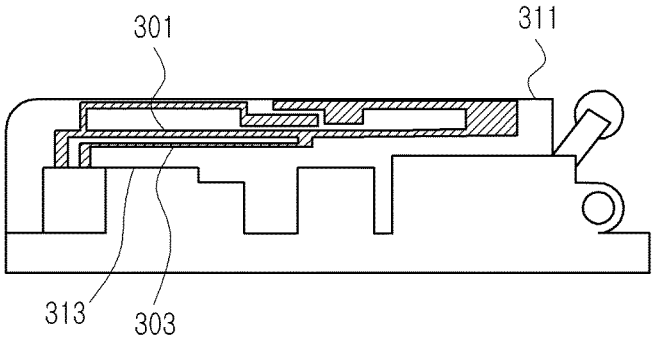
FIGS. 7, 8 and 9 illustrate exemplary embodiments based on the basic principle of the present invention.
Figure 8:
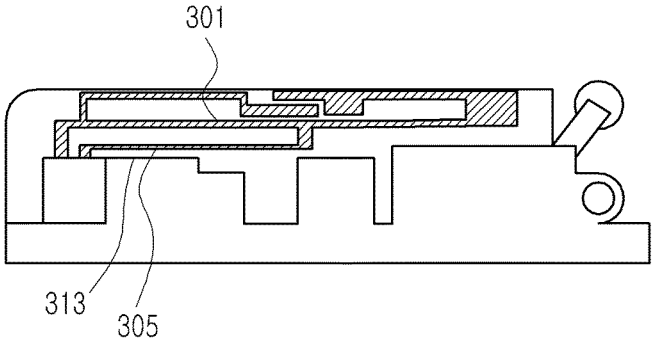
Figure 9:
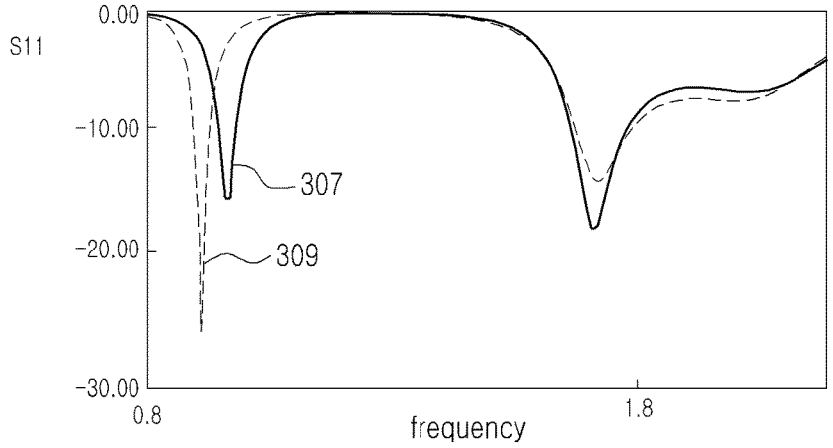

FIGS. 7, 8 and 9 illustrate exemplary embodiments based on the basic principle of the present invention.

Specifically, FIG. 7 illustrates an antenna structure having a large amount of coupling according to an exemplary embodiment of the present invention, FIG. 8 illustrates an antenna structure having a small amount of coupling according to an exemplary embodiment of the present invention, and FIG. 9 is a graph illustrating reflection coefficients S11 with respect to frequencies of the antenna structures illustrated in FIGS. 7 and 8.

Referring to FIGS. 7 and 8, shorting pins 303 and 305 are of the same length within a housing 311. However, the shorting pin 303 is nearer to a radiation patch 301 than the shorting pin 305. The ground plane 313 is also shown. Therefore, a much larger amount of coupling occurs in the antenna structure of FIG. 7 than in the antenna structure of FIG. 8. This is because as a shorting pin is nearer to a radiation patch, coupling increases in amount and thus impedance changes more greatly.

Referring to FIG. 9, a solid line 307 denotes reflection coefficients of the antenna structure illustrated in FIG. 8 and a dotted line 309 denotes reflection coefficients of the antenna structure illustrated in FIG. 7. A comparison between the curves 307 and 309 reveals that the antenna structures of FIGS. 7 and 8 have very different frequencies corresponding to minimum reflection coefficients, that is, very different operating frequencies, especially in the vicinity of a low frequency band.

The antenna structure of FIG. 7 experiences a large amount of coupling because the distance between the radiation patch 301 and the shorting pin 303 is small. Therefore, the resonant frequency of the antenna structure illustrated in FIG. 7 is lower than that of the antenna structure illustrated in FIG. 8, in the low frequency band. The antenna structure of FIG. 8 experiences a small amount of coupling because the distance between the radiation patch 301 and the shorting pin 305 is large. Therefore, the antenna structure illustrated in FIG. 8 resonates at a relatively high frequency in the low frequency band.

FIGS. 10 to 13 illustrate the structures of switchable antennas according to exemplary embodiments of the present invention.

The switchable antennas illustrated in FIGS. 10 to 13 are merely exemplary applications given for illustrative purposes, to which the present invention is not limited. Thus, modifications can be made to the switchable antennas based on the basic principle of the present invention.

In FIGS. 10 to 13, reference character F denotes a feed point, reference character G denotes a ground, and reference characters a and b denote shorting pins. While two shorting pins are shown for the convenience s sake of description, three or more shorting pins may be used depending on an antenna design.

Figure 10:
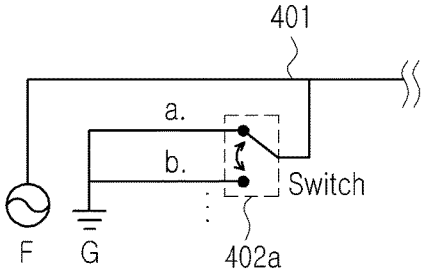
FIGS. 10 to 13 illustrate the structures of switchable antennas according to exemplary embodiments of the present invention.

Referring to FIG. 10, the shorting pins a and b are connected to the ground G and a switch 402*a* is connected to a radiation patch 401. The switch 402*a* may switch one of the shorting pins a and b to the radiation patch according to an intended frequency band for the switchable antenna. Thus the resonant frequency of the switchable antenna can be changed to a target frequency.

Figure 11:
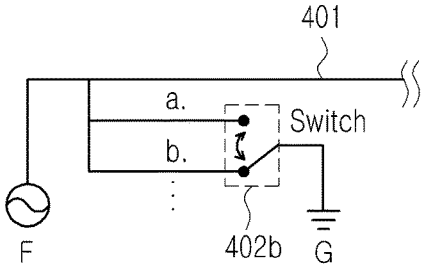

Referring to FIG. 11, the shorting pins a and b are connected to the radiation patch 401 and a switch 402*b* is connected to the ground G.

Figure 12:
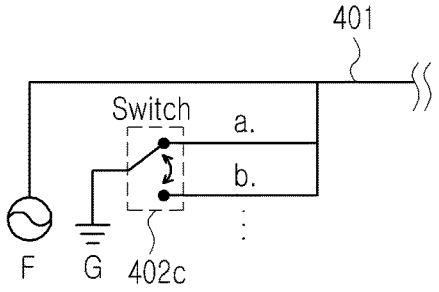

Referring to FIG. 12, the shorting pins a and b are connected to the radiation patch 401 and a switch 402*c* is connected to the ground G.

Figure 13:
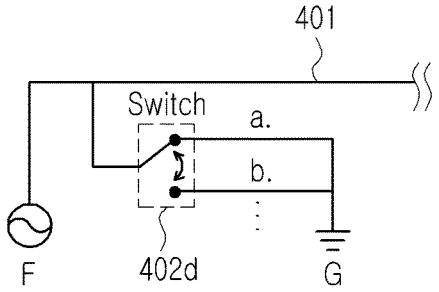

Referring to FIG. 13, the shorting pins a and b are connected to the ground G and a switch 402*d* is connected to the radiation patch 401.

Figure 14:
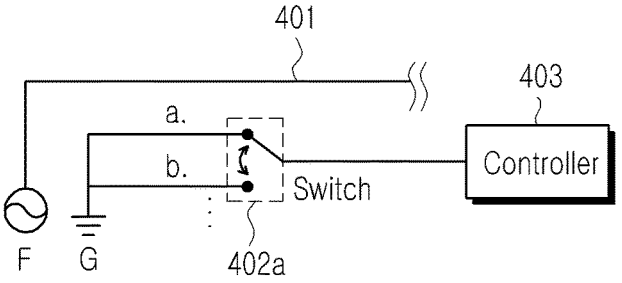
FIG. 14 illustrates an apparatus for adjusting the operating frequency of a switchable antenna according to an exemplary embodiment of the present invention.

FIG. 14 illustrates an apparatus for adjusting the operating frequency of an antenna according to an exemplary embodiment of the present invention.

The apparatus illustrated in FIG. 14 is shown as controlling the operating frequency of the antenna illustrated in FIG. 10. That is, a controller 403 is added in connection to the switch 402*a* in the antenna of FIG. 10. The controller 403 controls the switch 402*a* to switch to the shorting pin a or b according to a target operating frequency for the antenna so that the antenna has an impedance corresponding to the target operating frequency. Needless to say, an operating frequency adjusting apparatus similar to that illustrated in FIG. 14 may be designed based on either of the antenna structures illustrated in FIGS. 11, 12 and 13.

Figure 15:
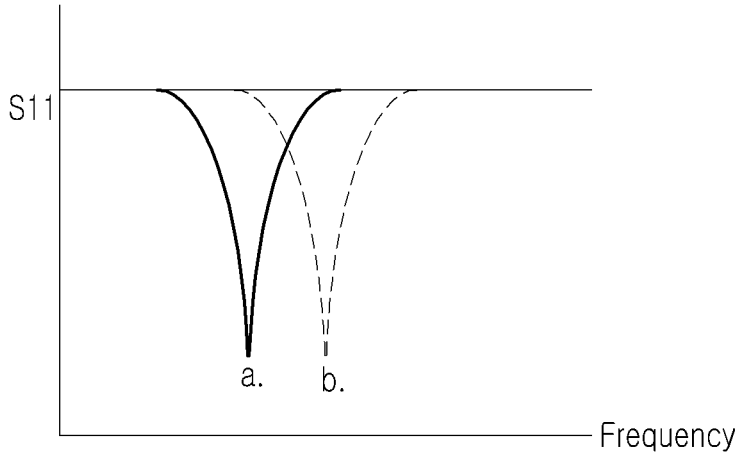
FIG. 15 is a graph illustrating a change in the resonant frequency of the antennas illustrated in FIGS. 10 to 13.

FIG. 15 is a graph illustrating a change in the resonant frequency of the antennas illustrated in FIGS. 10 to 13.

Referring to FIG. 15, the graph illustrates resonant frequencies in both cases where each of the switches 402*a* to 402*d* switches to the shorting pins a and b in the antennas illustrated in FIGS. 10 to 13. If the switch is connected to the shorting pin a, a large amount of coupling occurs. Therefore, the antenna resonates at a low frequency in a low band. On the other hand, if the switch is connected to the shorting pin b, a small amount of coupling occurs. Therefore, the antenna resonates at a high frequency in the low band.

Figure 16:
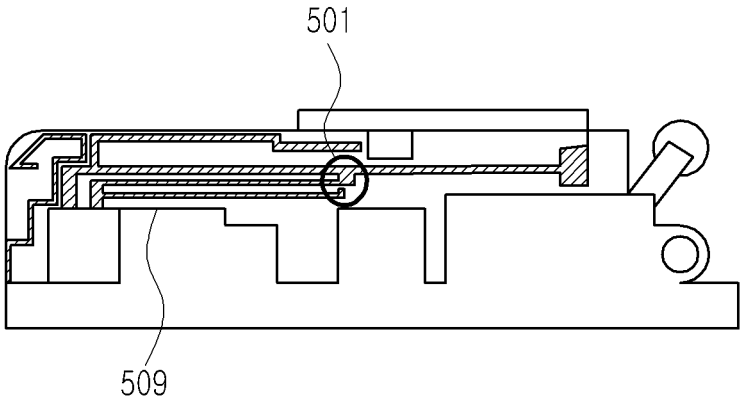
FIGS. 16 and 17 illustrate a real structure of a switchable antenna according to an exemplary embodiment of the present invention.
Figure 17:
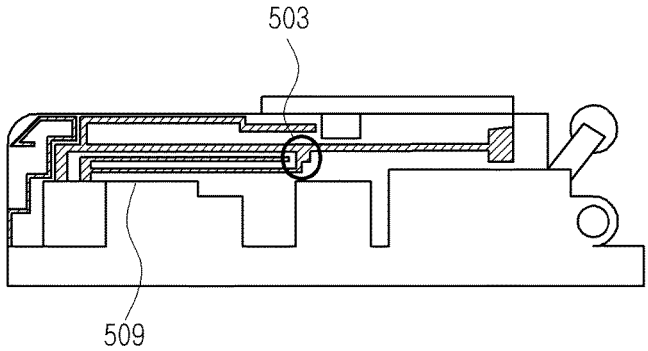
Figure 18:
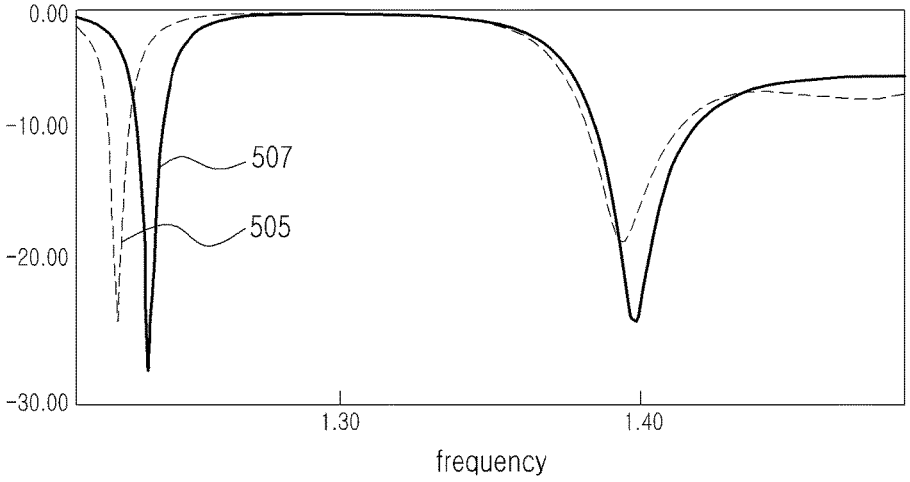
FIG. 18 is a graph illustrating reflection coefficients with respect to frequencies of the antenna illustrated in FIGS. 16 and 17.

FIGS. 16 and 17 illustrate an actual structure of a switchable antenna according to an exemplary embodiment of the present invention, and FIG. 18 is a graph illustrating reflection coefficients with respect to frequencies of the switchable antenna that operate as illustrated in FIGS. 16 and 17.

Referring to FIGS. 16 and 17, the switchable antenna is configured so as to include two shorting pins, by way of example. The antenna experiences a large amount of coupling as current flows through an upper shorting pin that is close to radiation patch 502, as indicated by reference numeral 501, and the antenna experiences a small amount of coupling as current flows through a lower shorting pin which is further from radiation patch 502, as indicated by reference numeral 503. The ground plane 509 is also shown.

Referring to FIG. 18, a dotted line 505 denotes reflection coefficients of the antenna when current flows through the upper shorting pin as illustrated in FIG. 16, and a solid line 507 denotes reflection coefficients of the antenna when current flows through the lower shorting pin as illustrated in FIG. 17. As described above, the antenna experiences more coupling in the state of FIG. 16 than in the state of FIG. 17. Therefore, the antenna resonates at a lower frequency in a low band in FIG. 16 than in FIG. 17.

Figure 19:
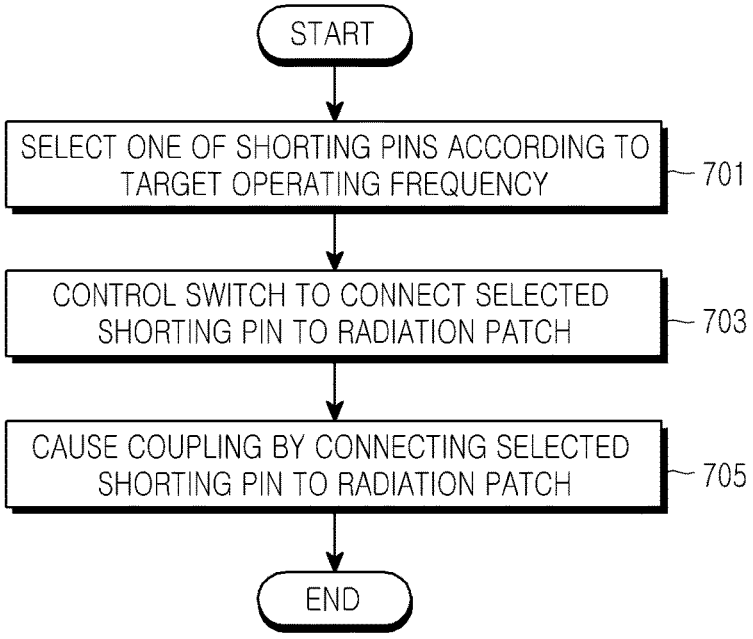
FIG. 19 illustrates a method for adjusting the operating frequency of an antenna according to an exemplary embodiment of the present invention.

FIG. 19 is a flowchart illustrating a method for adjusting the operating frequency of an antenna according to an exemplary embodiment of the present invention.

Referring to FIG. 19, the controller 403 selects one of the plurality of shorting pins according to a target operating frequency for the antenna in step 701. In step 703, the controller 403 controls the switch to connect the selected shorting pin to the radiation patch. As the switch switches the selected shorting pin to the radiation patch, coupling occurs between the shorting pin and the radiation patch in step 705.

It has been described above that to implement a multi-band antenna, the amount of coupling is controlled by changing the distance between a radiation patch and a shorting pin in the antenna, to thereby operate the antenna in a target operating frequency according to an exemplary embodiment of the present invention.

A modification can be made to the present invention such that the amount of coupling is controlled by changing the distance between a ground and a shorting pin in an antenna. In this case, since the amount of coupling is determined by the distance between the ground plane and the shorting pin, the antenna may be configured so that shorting pins are provided relatively near to the ground plane.

The present invention is applicable to both high and low frequency bands in a wireless communication system. For operation in a high frequency band, a small-size antenna is needed. Hence, a multi-band antenna for a high frequency band can be implemented in a portable terminal without using the switchable antenna of the present invention. On the other hand, since a relatively large antenna is required for operation in a low frequency band, using the switchable antenna of the present invention will be efficient.

While the invention has been shown and described with reference to certain exemplary embodiments of the present invention thereof, it will be understood by those skilled in the art that various changes in form and details may be made therein without departing from the spirit and scope of the present invention as defined by the appended claims and their equivalents.

The invention claimed is:

1. A multi-band antenna comprising:

a radiation patch directly connected to a feed point;

a plurality of shorting pins permanently affixed to each other at one end and spaced from the radiation patch by different distances; and a switch configured to connect one of the shorting pins to a ground plane, wherein a resonant frequency of the multi-band antenna in a low band is a first frequency related to a minimum reflection coefficient of the multi-band antenna in the low band if a distance between a first short pin of the shorting pins and the radiation patch is smaller than a predetermined value, wherein the resonant frequency of the multi-band antenna in the low band is a second frequency being higher than the first frequency in the low band if a distance between a second short pin of the shorting pins and the radiation patch is equal to or larger than the predetermined value, and wherein a length of a first path from the feed point via the first short pin to the ground plane is same as a length of a second path from the feed point via the second short pin to the ground plane.

2. The multi-band antenna of claim 1, further comprising a controller for controlling the switch to select the one of the shorting pins according to an operating frequency of the multi-band antenna.

3. The multi-band antenna of claim 1, wherein the multi-band antenna is one of an inverted f-antenna (IFA) or a planar inverted f-antenna (PIFA).

4. A multi-band antenna comprising:

a radiation patch directly connected to a feed point;

a plurality of shorting pins permanently affixed to each other at one end and spaced from a ground plane of the multi-band antenna by different distances; and a switch configured to connect one of the shorting pins to the ground plane, wherein a resonant frequency of the multi-band antenna in a low band is a first frequency related to a minimum reflection coefficient of the multi-band antenna in the low band if a distance between a first short pin of the shorting pins and the ground plane is smaller than a predetermined value, wherein the resonant frequency of the multi-band antenna in the low band is a second frequency being higher than the first frequency in the low band if a distance between a second short pin of the shorting pins and the radiation patch is equal to or larger than the predetermined value, and wherein a length of a first path from the feed point via the first short pin to the ground plane is same as a length of a second path from the feed point via the second short pin to the ground plane.

5. The multi-band antenna of claim 4, further comprising a controller for controlling the switch to select the one of the shorting pins according to an operating frequency of the multi-band antenna.

6. The multi-band antenna of claim 4, wherein the multi-band antenna is one of an inverted f-antenna (IFA) or a planar inverted f-antenna (PIFA).

7. A method for controlling an operating frequency of a multi-band antenna having a radiation patch and a plurality of shorting pins permanently affixed to each other at one end and spaced from the radiation patch by different distances, the method comprising:

selecting, by a controller configured to connect one of the shorting pins to a ground plane, the selected shorting pin according to an operating frequency of the multi-band antenna set by the controller; and connecting the selected shorting pin to the ground plane by a switch, wherein the radiation patch is directly connected to a feed point, wherein a resonant frequency of the multi-band antenna in a low band is a first frequency related to a minimum reflection coefficient of the multi-band antenna in the low band if a distance between a first short pin of the shorting pins and the radiation patch is smaller than a predetermined value, wherein the resonant frequency of the multi-band antenna in the low band is a second frequency being higher than the first frequency in the low band if a distance between a second short pin of the shorting pins and the radiation patch is equal to or larger than the predetermined value, and wherein a length of a first path from the feed point via the first short pin to the ground plane is same as a length of a second path from the feed point via the second short pin to the ground plane.

8. The method of claim 7, wherein the multi-band antenna is one of an inverted f-antenna (IFA) and a planar inverted f-antenna (PIFA).

9. A method for controlling an operating frequency of a multi-band antenna having a radiation patch and a plurality of shorting pins permanently affixed to each other at one end and spaced from a ground plane by different distances, the method comprising:

selecting, by a controller configured to connect one of the shorting pins to a ground plane, the selected shorting pin according to an operating frequency of the multi-band antenna set by the controller; and connecting the selected shorting pin to the ground plane by a switch, wherein the radiation patch is directly connected to a feed point, wherein a resonant frequency of the multi-band antenna in a low band is a first frequency related to a minimum reflection coefficient of the multi-band antenna in the low band if a distance between a first short pin of the shorting pins and the ground plane is smaller than a predetermined value, wherein the resonant frequency of the multi-band antenna in the low band is a second frequency being higher than the first frequency in the low band if a distance between a second short pin of the shorting pins and the radiation patch is equal to or larger than the predetermined value, and wherein a length of a first path from the feed point via the first short pin to the ground plane is same as a length of a second path from the feed point via the second short pin to the ground plane.

10. The method of claim 9, wherein the multi-band antenna is one of an inverted f-antenna (IFA) or a planar inverted f-antenna (PIFA).

* * * * *